US010627062B2

(12) United States Patent
Chen

(10) Patent No.: US 10,627,062 B2
(45) Date of Patent: Apr. 21, 2020

(54) METHOD FOR REALIZING FAST COLOR MIXING OF ANY COLORS

(71) Applicant: GUANGZHOU YAJIANG PHOTOELECTRIC EQUIPMENT CO., LTD., Guangzhou, Guangdong (CN)

(72) Inventor: Zhiman Chen, Guangdong (CN)

(73) Assignee: GUANGZHOU YAJIANG PHOTOELECTRIC EQUIPMENT CO., LTD., Guangzhou (CN)

( * ) Notice: Subject to any disclaimer, the term of this patent is extended or adjusted under 35 U.S.C. 154(b) by 0 days.

(21) Appl. No.: 16/262,989

(22) Filed: Jan. 31, 2019

(65) Prior Publication Data

US 2019/0162377 A1 May 30, 2019

Related U.S. Application Data

(63) Continuation-in-part of application No. PCT/CN2018/084915, filed on Apr. 27, 2018.

(30) Foreign Application Priority Data

Mar. 24, 2017 (CN) ..... 2017 1 0183658

(51) Int. Cl.
*F21S 10/02* (2006.01)
*F21V 23/00* (2015.01)
(Continued)

(52) U.S. Cl.
CPC ..... *F21S 10/02* (2013.01); *F21V 23/003* (2013.01); *H05B 45/20* (2020.01); *H05B 47/10* (2020.01); *F21Y 2113/10* (2016.08)

(58) Field of Classification Search
CPC ..... F21S 10/02; F21V 23/003; H05B 37/02
(Continued)

(56) References Cited

U.S. PATENT DOCUMENTS 5,384,519 A * 1/1995 Gotoh ..... H05B 41/3921 315/324
5,803,579 A * 9/1998 Turnbull ..... B60L 1/14 362/516
(Continued)

OTHER PUBLICATIONS

International Search Report of PCT Patent Application No. PCT/CN2018/084915 dated Jul. 23, 2018.
(Continued)

*Primary Examiner* — Bryon T Gyllstrom

(57) ABSTRACT

A method for realizing fast color mixing of any colors is disclosed. When the number of colors to be mixed is three, the first illuminance ratio between the three colors to be mixed that required for obtaining the target color is calculated. When the number of colors to be mixed exceeds three, the mixed color of other colors except the first and second color is determined firstly according to a settled second illuminance ratio between other colors except for a first and a color, then a third illuminance ratio between the first color, the second color and the mixed color of other colors except for the first and second color for obtaining the target color is calculated. This method can quickly determine the first illuminance ratio between three or more colors to be mixed according to the target color and the illuminance ratio of certain mixed color.

8 Claims, 1 Drawing Sheet

(51) Int. Cl.
*H05B 45/20* (2020.01)
*H05B 47/10* (2020.01)
*F21Y 113/10* (2016.01)

(58) Field of Classification Search
USPC ..... 362/231
See application file for complete search history.

(56) References Cited

U.S. PATENT DOCUMENTS 6,411,046 B1 * 6/2002 Muthu ..... H05B 33/0869 315/309
8,177,389 B1 * 5/2012 Kropf ..... G01J 1/32 362/231
2003/0133292 A1 * 7/2003 Mueller ..... A45D 42/10 362/231
2004/0052076 A1 * 3/2004 Mueller ..... F21V 23/0442 362/293
2004/0105261 A1 * 6/2004 Ducharme ..... H05B 33/0857 362/231
2004/0218387 A1 * 11/2004 Gerlach ..... F21K 9/00 362/231
2006/0098077 A1 * 5/2006 Dowling ..... H05B 37/02 347/130
2006/0104058 A1 * 5/2006 Chemel ..... H05B 33/0842 362/231
2006/0158881 A1 * 7/2006 Dowling ..... G03G 15/0435 362/231
2009/0278476 A1 * 11/2009 Baaijens ..... H05B 33/0863 315/297
2013/0342132 A1 * 12/2013 Jorgensen ..... H05B 37/02 315/297

OTHER PUBLICATIONS

Wei Li et al., Research on LED Color-mixing Technology of Mood Lighting System ( I ), China Light & Lighting, Oct. 31, 2009, pp. 8-10, No. 10.
Xinguang LV, Relationship of Spectral Tristimulus Values with Tricolor Unitage, Packaging Engineering, Oct. 31, 2002, pp. 40-41, vol. 23, No. 5.

* cited by examiner

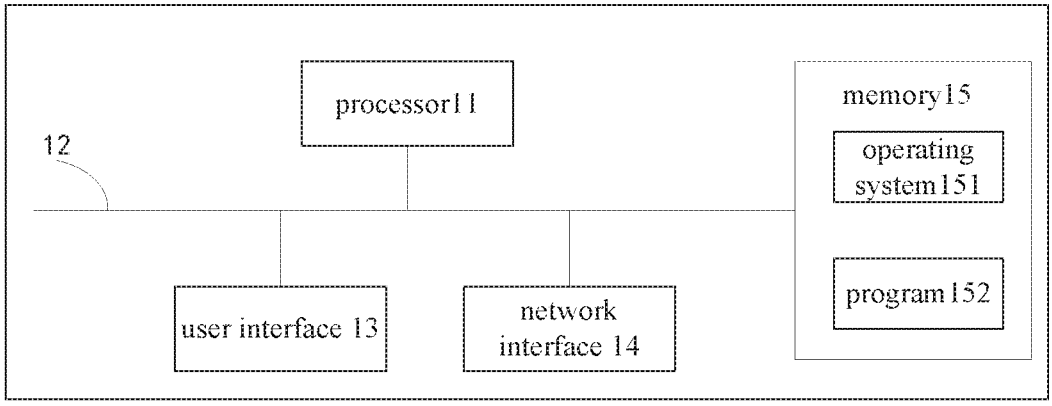
processor11
12
memory15
operating system151
program152
user interface 13
network interface 14

METHOD FOR REALIZING FAST COLOR MIXING OF ANY COLORS

CROSS-REFERENCE TO RELATED APPLICATIONS

The present application is a Continuation-in-part Application of PCT application No. PCT/CN2018/084915 filed on Apr. 27, 2018, which claims the priority of Chinese patent application No. 201710183658.4 filed on Mar. 24, 2017. The contents of the above are hereby incorporated by reference.

FIELD OF THE INVENTION

The present invention relates to color mixing and more specifically to a method for realizing fast color mixing of any colors.

BACKGROUND OF THE INVENTION

So far, color mixing is carried out in general by continually exploring and testing to adjust the proportion of the colors to be mixed (raw colors), so as to finally obtain the desired target color. This method is complicated and inefficient.

SUMMARY OF THE INVENTION

The present invention seeks to solve these issues by introducing methods that can quickly realize color mixing of any colors; the method can quickly calculate the illuminance ratio between three or more colors to be mixed required for making the target color according to the target color and the illuminance ratio of some mixed color; the method has a simple calculation process as well as high efficiency.

To solve these problems, the present invention is directed to a method for realizing fast color mixing of any colors, including following steps:

receiving target chromaticity coordinates, colors to be mixed and setting information of chromaticity coordinates of the colors to be mixed;

when a number of the colors to be mixed is three, calculating an first illuminance ratio between the colors to be mixed according to a correlation between chromaticity coordinates and tristimulus values;

when the number of the colors to be mixed exceeds three, setting a second illuminance ratio between other colors except for a first and a second color of the colors to be mixed as a preset illuminance ratio, obtaining a mixed color of the other colors according to the preset illuminance ratio; calculating a third illuminance ratio between the first color, the second color and the mixed color according to the correlation between chromaticity coordinates and tristimulus values, thus obtaining the first ratio between the colors to be mixed; and mixing the colors to be mixed according to the first illuminance ratio to obtain the target chromaticity coordinates.

Alternatively, when the number of said colors to be mixed is four, the first illuminance ratio is calculated in another manner characterized by steps of:

determining an illuminance of a fourth color;

calculating a fourth illuminance ratio between the fourth color and a mixed color of other three colors for achieving the target chromaticity coordinates according to the correlation between chromaticity coordinates and tristimulus values; and calculating a fifth illuminance ratio between the other three colors according to the correlation between the tristimulus values and the chromaticity coordinates.

Preferably, when the number of said colors to be mixed is three, 1:Cr2:Cr3 is the first illuminance ratio between the colors to be mixed, wherein $$Cr2 = \frac{x1 - x - Ar2 * Cr3}{Ar1},\ Cr3 = \frac{\left(\frac{x1 - x}{Ar1} - \frac{y1 - y}{Br1}\right)}{\left(\frac{Ar2}{Ar1} - \frac{Br2}{Br1}\right)},$$

$$Ar1 = \frac{x * y1}{y2} - \frac{x2 * y1}{y2},\ Ar2 = \frac{x * y1}{y3} - \frac{x3 * y1}{y3},$$

$$Br1 = \frac{y * y1}{y2} - y1 \text{ and } Br2 = \frac{y * y1}{y3} - y1,$$

x and y are the target chromaticity coordinates, (x1, y1), (x2, y2) and (x3, y3) are the chromaticity coordinates of the three colors to be mixed respectively.

Preferably, when the number of said colors to be mixed is four, the first illuminance ratio between the four colors to be mixed is calculated as $$1{:}Cr2{:}\frac{Cr3}{1 + C2}{:}C2 * Cr3(1 + C2),$$

wherein the second illuminance ratio between a third color and a fourth color is 1:C2, and the third illuminance ratio between the first color, the second color and the mixed color of the third color and fourth color is 1:Cr2:Cr3.

Preferably, when the number of said colors to be mixed is five, the first illuminance ratio between the five colors to be mixed is calculated as $$1{:}Cr2{:}\frac{1}{Cr3}{:}\frac{C3}{Cr3}{:}\frac{C4}{Cr3},$$

wherein the second illuminance ratio between a third color, a fourth color, and a fifth color is 1:C3:C4, and the third illuminance ratio between the first color, the second color and the mixed color of the third color, fourth color, and the fifth color is 1:Cr2:Cr3.

Alternatively, when the number of said colors to be mixed is four, the first illuminance ratio between the other three colors and the fourth color is calculated as 1:Cr2:Cr3:C*(1+Cr2+Cr3), wherein 1:Cr2:Cr3 is the fifth illuminance ratio between the other three colors, the fourth illuminance ratio between the fourth color and the mixed color of the other three colors is 1:C.

The present invention herein further includes a corresponding apparatus for realizing fast color mixing of any colors. The apparatus comprises a processor, a memory, and a computer program stored in the memory and configured to be executed by said processor. Above mentioned method for fast implementation of color mixing of any colors is realized when said processor executes said computer program.

Compared with the prior art, the beneficial effects of this invention are described as follows. According to the present embodiments, if three colors are to be mixed, the first illuminance ratio between the three colors to be mixed for obtaining the target color is calculated firstly according to the correlation between the chromaticity coordinates and the tristimulus values; if more than three colors are to be mixed, the mixed color of other colors except for the first and second color is determined according to a settled second illuminance ratio between other colors except for the first and second color by using the correlation between the chromaticity coordinates and the tristimulus value; then the third illuminance ratio between the first color; the second color and the mixed color of other colors except for the first and second color for obtaining the target color is calculated according to the correlation between the chromaticity coordinates and the tristimulus values. The present invention can quickly determine the first illuminance ratio between three or more colors to be mixed according to the target color and the second illuminance ratio of certain mixed color.

BRIEF DESCRIPTION OF DRAWINGS

The sole FIGURE is a schematic view of the apparatus for realizing fast color mixing of any colors according to at least one embodiment of the present invention.

DETAILED DESCRIPTION OF ILLUSTRATED EMBODIMENTS

The present invention provides a method for realizing fast color mixing of any colors. The method can be executed by a device for realizing fast color mixing of any colors, comprising following steps:

receiving target chromaticity coordinates, colors to be mixed and setting information of chromaticity coordinates of the colors to be mixed;

when a number of the colors to be mixed is three, calculating an first illuminance ratio between the colors to be mixed according to a correlation between chromaticity coordinates and tristimulus values;

when the number of the colors to be mixed exceeds three, setting a second illuminance ratio between other colors except for a first and a second color of the colors to be mixed as a preset illuminance ratio, obtaining a mixed color of the other colors according to the preset illuminance ratio; calculating a third illuminance ratio between the first color, the second color and the mixed color according to the correlation between chromaticity coordinates and tristimulus values, thus obtaining the first ratio between the colors to be mixed; and mixing the colors to be mixed according to the first illuminance ratio to obtain the target chromaticity coordinates.

An apparatus for realizing fast color mixing of any colors is further provided in accordance with one embodiment of the present invention. The apparatus for realizing fast color mixing of any colors, comprising a processor, a memory, and a computer program stored in said memory and configured to be executed by the processor, wherein the above mentioned method for realizing fast color mixing of any colors is implemented when the processor executes said computer program.

The abovementioned apparatus for realizing fast color mixing of any colors provided in present invention may be computing devices such as computer, mobile phone, tablet PC, notebook, server, or the like. The method for realizing fast color mixing of any colors can be integrated as a function module in the said apparatus for realizing fast color mixing of any colors, and executed by said apparatus for realizing fast color mixing of any colors.

Based on the known target color, the target color can be quickly achieved by mixing multiple monochromatic light sources through calculating the illuminance ratio between various monochromes. The calculation procedures are as follows:

The chromaticity coordinates of 1931CIE standard colorimetric system are calculated based on the tristimulus values of RGB, then the x, y and z values are given by:

$$x = \frac{X}{X+Y+Z},\ y = \frac{Y}{X+Y+Z},\ z = \frac{Z}{X+Y+Z}$$

Where x and y represent the chromaticity coordinates, X, Y and Z represent the tristimulus values, and Y represents the lightness.

The chromaticity coordinates of the three raw colors are set as (x1, y1), (x2, y2) and (x3, y3) respectively, the target chromaticity coordinates are (x, y); their corresponding tristimulus values are (X1, Y1, Z1), (X2, Y2, Z2), (X3, Y3, Z3) and (X, Y, Z) respectively; according to the correlation between tristimulus values and chromaticity coordinates:

$$x1 = \frac{X1}{X1+Y1+Z1} \tag{1}$$

$$y1 = \frac{Y1}{X1+Y1+Z1} \tag{2}$$

$$x2 = \frac{X2}{X2+Y2+Z2} \tag{3}$$

$$y2 = \frac{Y2}{X2+Y2+Z2} \tag{4}$$

$$x3 = \frac{X3}{X3+Y3+Z3} \tag{5}$$

$$y3 = \frac{Y3}{X3+Y3+Z3} \tag{6}$$

the target chromaticity coordinates (x, y) are given by $$x = \frac{X1+X2+X3}{X1+X2+X3+Y1+Y2+Y3+Z1+Z2+Z3} \tag{7}$$

$$y = \frac{Y1+Y2+Y3}{X1+X2+X3+Y1+Y2+Y3+Z1+Z2+Z3} \tag{8}$$

Cr2 and Cr3 can be figured out by substituting Y1:Y2:Y3=1:Cr2:Cr3 in the above equations:

$$Cr3 = \frac{\left(\frac{x1-x}{Ar1} - \frac{y1-y}{Br1}\right)}{\left(\frac{Ar2}{Ar1} - \frac{Br2}{Br1}\right)} \tag{9}$$

$$Cr2 = \frac{x1 - x - Ar2 * Cr3}{Ar1} \tag{10}$$

Wherein $$Ar1 = \frac{x * y1}{y2} - \frac{x2 * y1}{y2}$$

$$Ar2 = \frac{x * y1}{y3} - \frac{x3 * y1}{y3}$$

-continued $$Br1 = \frac{y * y1}{y2} - y1$$

$$Br2 = \frac{y * y1}{y3} - y1;$$

And 1:Cr2:Cr3 is the first illuminance ratio between the three colors to be mixed for achieving the target chromaticity coordinates.

a. When three colors RGB are used for color mixing, the target color can be achieved simply by adjusting the first illuminance ratio between the three colors to be mixed to 1:Cr2:Cr3.

b. When four colors RGBW are used for color mixing, there are two calculation approaches:

Approach 1: determining the illuminance of one color to be mixed firstly, calculating the mixed color (x, y) of other three colors to be mixed, then calculating the fifth ratio between other three colors to be mixed by formula (9) and (10). Detailed calculation procedures are as follows:

The chromaticity coordinates of the target color O are (x0, y0), the chromaticity coordinates of the fourth color W is (x4, y4); the chromaticity coordinates of the mixed color M of other three colors according to the fifth illuminance ratio of 1:Cr2:Cr3 are (x, y); according to the relation formulas of tristimulus value and chromaticity coordinate (1), (2), (3) and (4), and the formula of the target chromaticity coordinates are given as:

$$x = \frac{X1 + X2}{X1 + X2 + Y1 + Y2 + Z1 + Z2} \tag{11}$$

$$y = \frac{Y1 + Y2}{X1 + X2 + Y1 + Y2 + Z1 + Z2} \tag{12}$$

(x0, y0), (x4, y4) and the fourth illuminance ratio of 1:C between the fourth color and the mixed color M of other three colors to be mixed are substituted in the formulas, the chromaticity coordinates of the mixed color M can be obtained:

$$x = x4 * B,\ y = \frac{y4}{A}$$

Wherein $$A = \frac{(1 + C) * \frac{y4}{y0} - 1}{C}$$

$$B = \frac{(1 + A * C) * \frac{x0}{x4} - 1}{A * C}$$

Subsequently, (x, y) are substituted into the formula (9), (10), and the Cr2 and Cr3 can be figured out. Hence, the first illuminance ratio between the four colors to be mixed is determined as 1:Cr2:Cr3:C*(1+Cr2+Cr3).

Approach 2: determining the second illuminance ratio between any two colors of the colors to be mixed firstly, taking the mixed color of the two colors as one color, which is mixed with the two colors of the colors to be mixed, and then calculating the first blending ratio. The detailed calculation procedures are as follows:

Color B (x3, y3) and color W (x4, y4) are set to be mixed in the blending second ratio of 1:C2, to get the mixed color M (x0, y0); the chromaticity coordinates of the mixed color can be calculated by the formula (1), (2), (3), (4), (11), (12):

$$x0 = x3 * \frac{1 + B2 * C2 * A2}{1 + A2 * C2} \tag{13}$$

$$y0 = y3 * \frac{1 + C2}{1 + A2 * C2} \quad \text{Where} \tag{14}$$

$$A2 = \frac{y3}{y4},\ B2 = \frac{x4}{x3},\ C2 = \frac{E4}{E3};$$

Subsequently, M (x0, y0) is substituted into the formula (9), (10), and the Cr2 and Cr3 are calculated. The first illuminance ratio between the four colors to be mixed is determined as $$1:Cr2:\frac{Cr3}{1 + C2}:C2 * Cr3(1 + C2).$$

c. When five colors RGBWA are used for color mixing, determining the second illuminance ratio between any three colors of the colors to be mixed firstly, taking the mixed color of the three colors according to the second illuminance ratio as one color, which is obtained by mixing the three colors of the colors to be mixed, and then calculating the first blending ratio. The detailed calculation procedures are as follows:

color B (x3, y3), color W (x4, y4) and color A (x5, y5) are set to be mixed in the second blending ratio of 1:C3:C4 to obtain the mixed color M (x0, y0), then, the chromaticity coordinates of the mixed color M can be calculated by the formula (1) to (8):

$$x0 = x3 * \frac{1 + B3 * C3 * A3 + B4 * C4 * A4}{1 + A4 * C4 + A3 * C3}$$

$$y0 = y3 * \frac{1 + C4 + C3}{1 + A4 * C4 + A3 * C3} \quad \text{Where}$$

$$A3 = \frac{y3}{y4},\ A4 = \frac{y3}{y5},\ B3 = \frac{x4}{x3},\ B4 = \frac{x5}{x3},\ C3 = \frac{E4}{E3},\ C4 = \frac{E5}{E3};$$

Then M (x0, y0) is substituted into the formula (9) and (10), and the Cr2, Cr3 are calculated; the first illuminance ratio between the five colors to be mixed is determined as $$1:Cr2:\frac{1}{Cr3}:\frac{C3}{Cr3}:\frac{C4}{Cr3}.$$

For the situation of mixing colors for more than five colors, the mixed color of other colors except for any two colors according to a predetermined second ratio can be taken as one color; then the target color can be obtained by mixing the mixed color with the two colors.

If the illuminance of the target color is a fixed value, the color mixing of the required illuminance can be achieved by calculating the illuminance of each color according to the proportion of each color.

After the above calculation, no matter whether a target color is mixed by three colors or more than three colors, the color mixing for obtaining the target color can be quickly realized by calculation, which has the advantages of simple procedure, fast speed, high efficiency.

The aforementioned color mixing methods of the present invention, as well as additional objects and advantages thereof, will be more fully understood herein by discussing some detailed examples.

the first example: color mixing for three colors.

The chromaticity coordinates and illuminance of said three colors are known as R(0.688, 0.3085) E1=4001x, G(0.1681, 0.6938) E2=6001x and B(0.239, 0.2373) E3=1201x respectively; chromaticity coordinates of the target color are (0.313, 0.337). According to the formula (9), (10), Cr2 and Cr3 are calculated as 2.17 and 2.44 respectively. In other words, RGB are mixed in the first illuminance ratio of 1:2.17:2.44, to obtain the target color (0.313, 0.337).

the second example: color mixing for four colors.

The chromaticity coordinates and illuminance of the target color mixed by RGBW are (0.313, 0.337), 15001x respectively. The chromaticity coordinates and illuminance of said four colors are known as R (0.688, 0.3085) E1=4001x, G(0.1681, 0.6938) E2=6001x, B (0.239, 0.2373) E3=1201x, W (0.2991, 0.3150) E4=8501x, respectively.

Approach 1: the chromaticity coordinates of the mixed color M are (x, y), which is mixed by RGB in the fifth ratio of 1:Cr2:Cr3. By mixing the fourth color W (0.2991, 0.3150) and said mixed color M (x, y) in the fourth ratio of 1:C, the target color with the chromaticity coordinates of (0.313, 0.337), the illuminance of 15001x can be obtained. The illuminance of color W is 8501x, then the value C is figured out as 0.7647. Consequently, the chromaticity coordinates of color M can be figured out as (0.3352, 0.3793), as well as the illuminance of 6501x according to formula (13), (14). According to the formula (9), (10), the values of Cr2 and Cr3 are calculated as 2.37 and 1.41, respectively. That is to say that the target color can be obtained by mixing RGBW in the first ratio of 1:2.37:1.41:6.25. To obtain the target color with the chromaticity coordinates of (0.313, 0.337) and the illuminance of 15001x, the illuminances of the RGBW can be figured out as 135.91x, 322.21x, 191.91x, 8501x, respectively.

Approach 2: firstly, color B and W are mixed in a second ratio of 1:7, thus the chromaticity coordinates of the mixed color M of color B and W are calculated as (0.2843, 0.2711) according to formula (13), (14), then parameter values of R, G, M are substituted into the formula (9), (10), the values of Cr2 and Cr3 are calculated as 2.9 and 5.76, respectively. The first illuminance ratio between RGBW is calculated as 1:2.9:0.72:5.04. That is to say the target color can be obtained by mixing RGBW in the first ratio of 1:2.9:0.72:5.04. If the illuminance of the target color is required to be 15001x, the illuminance of RGBW can be figured out as 155.31x, 450.31x, 111.81x, 782.61x, respectively. The target color with the chromaticity coordinates of (0.313, 0.337), the illuminance of 15001x can be obtained by mixing RGBW in the illuminance of 155.31x, 450.31x, 111.81x, 782.61x, respectively.

the Third example: color mixing for five colors.

The chromaticity coordinates and illuminance of said five colors are set as R (0.688, 0.3085) E1=4001x, G (0.1681, 0.6938) E2=6001x, B (0.239, 0.2373) E3=2001x; W (0.2991, 0.3150) E4=8501x, A (0.0.4125, 0.4755) E5=2201x, respectively; The chromaticity coordinates of the target color are (0.313, 0.337).

Firstly, color B, W and A are mixed in the second ratio of 1:4.25:1.1. The chromaticity coordinates of the mixed color M of color B, W and A are calculated to be (0.2996, 0.3172) according to formula (13) and (14). The target color with the chromaticity coordinates of (0.313, 0.337) can be obtained by mixing RGM in the third ratio of 1:Cr2:Cr3, and the values of Cr2 and Cr3 are calculated as 2.3, 17.4 according to the formula (9), (10). That is to say, the target color can be obtained by mixing RGBWA in the first ratio of 1:2.3:2.7:11.6:3. The target color with the chromaticity coordinates of (0.313, 0.337), the illuminance of 15001x can be obtained by mixing RGBW in the illuminance of 72.81x, 167.51x, 196.61x, 844.71x, 218.41x, respectively.

With reference to the FIGURE, a schematic view of the apparatus for realizing fast color mixing of any colors according to present invention is shown. As shown in FIGURE, the apparatus for realizing fast color mixing of any colors includes: at least one processor 11, such as CPU, at least one network interface 14 or other user interfaces 13, memory 15, at least one communication bus 12, which enables the communication link between these modules. Alternatively, the user interface 13 may include a USB interface or other standard interfaces and cable interfaces. The network interface 14 may optionally include a WI-FI interface or other wireless interfaces. Memory 15 may include a high-speed RAM memory, or may also comprise a non-volatile memory, such as at least one magnetic disk storage. Optionally, memory 15 may contain at least one storage device remote from the processor 11.

In some embodiments, memory 15 may store the following elements, such as executable module, data structure, or their subsets and extended sets:

operating system 151, comprises various system programs and is being used to provide basic services and process hardware-based tasks;

program 152.

Specifically, processor 11 is used to call the program 152 stored in the memory 15, and perform the method for realizing fast color mixing of any colors in accordance with the abovementioned embodiments.

In some exemplary embodiments of the present invention, said computer program can be divided into one or more modules/elements, said one or more modules/elements, which are stored in said memory, are executed by said processor to complete the present invention. Said one or more modules/elements may be a series of computer program instruction segments which are capable of carrying out a particular function, said instruction segments can be used to describe the execution process of said computer program in said apparatus for realizing fast color mixing of any colors.

Said apparatus for realizing fast color mixing of any colors may be computing devices such as desktop computers, notebooks, palmtops or cloud servers. Said apparatus for realizing fast color mixing of any colors may include, but is not limited to, a processor, a memory. A person skilled in the art may understand that the schematic diagram is merely an example of the apparatus for realizing fast color mixing of any colors, does not limit the scope of the apparatus for realizing fast color mixing of any colors, and the apparatus may include more components or fewer components than those in the FIGURE, some components may be combined, or different component may be used.

Said processor 11 may be a Central Processing Unit (CPU), or may also be other general-purpose processors, a digital Signal Processor (DSP), a application Specific Integrated Circuit (ASIC), a field-Programmable Gate Array (FPGA), or other programmable logic devices, a discrete gate or a transistor logic device, a discrete hardware component, or the like. The general-purpose processor may be a microprocessor, or may also be any other general processors or the like. The processor 11, which can connect different parts of the whole apparatus for quickly realize color mixing of any colors together by various interfaces and lines, is the control center of said apparatus for realizing fast color mixing of any colors.

Said memory 15 may be configured to store said computer program and/or module, said processor 11 achieves various functions of said apparatus for realizing fast color mixing of any colors by running or executing the computer program and/or module stored in said memory, and by calling the data stored in the memory. Said memory 15 may mainly include program area and data area, wherein the program area may store an operating system, an application program required for at least one function (such as a sound playback function, an image playback function, etc), and the like; the data area may store the data that were created according to the use of mobile phone (such as audio data, telephone book, etc). In addition, memory 15 may include high-speed random-access memory, or may also include nonvolatile memory, such as a hard disk, a memory, a pluggable hard disk, a smart media card (SMC), a secure digital card (SD card), a flash card, at least one disk storage device, a flash memory, or other volatile solid-state memory devices.

Wherein, said modules/elements that are integrated by the apparatus for realizing fast color mixing of any colors can be stored in the readable storage medium of a computer if they are implemented in the form of software function unit and sold or used as an independent product. From this point of view, all or parts of the realization processes of said method in abovementioned embodiments of present invention may also be done with the related hardware instructed by the computer programs. Said computer programs can be stored in a computer-readable storage medium, and steps of the methods in above mentioned embodiments can be realized when said computer program is executed by said processor. Wherein, said computer program comprises computer program code, said computer program code may be in source code forms, object code forms, executable files or other intermediate forms, etc. Said computer readable medium may include: any entities or devices capable of carrying said computer program code, a recording medium, a USB flash disk, a mobile hard disk, a magnetic disk, a light disk, a computer storage, a read-only memory (ROM), a random access memory (RAM), an electrical carrier signal, an electrical signal or a software distribution medium, etc. It should be noted that the information contained in said computer readable medium may be properly increased or decreased according to the requirements of the legislation and the patent practice in a jurisdiction, for example, in some jurisdictions, computer readable medium does not comprise electrical carrier signal and electrical signal according to their legislation and patent practice.

The beneficial effects of this invention are as follows. According to the present embodiments, if three colors are to be mixed, the first illuminance ratio between the three colors to be mixed d for obtaining the target color is calculated firstly according to the correlation between the chromaticity coordinates and the tristimulus values; if more than three colors are to be mixed, the mixed color of other colors except for the first and second color is determined according to a settled second illuminance ratio between other colors except for the first and second color by using the correlation between the chromaticity coordinates and the tristimulus value; then a third illuminance ratio between the first color; the second color and the mixed color of other colors except for the first and second color for obtaining the target color is calculated according to the correlation between the chromaticity coordinates and the tristimulus values. The present invention can quickly determine the first illuminance ratio between three or more colors to be mixed according to the target color and the second illuminance ratio of certain mixed color.

What is claimed is:

1. A method for realizing fast color mixing of any colors, wherein the method comprises steps of receiving target chromaticity coordinates, colors to be mixed and setting information of chromaticity coordinates of the colors to be mixed;

when a number of the colors to be mixed is three, calculating a first illuminance ratio between the colors to be mixed according to a correlation between chromaticity coordinates and tristimulus values;

when the number of the colors to be mixed exceeds three, setting a second illuminance ratio between other colors except for a first and a second color of the colors to be mixed as a preset illuminance ratio, obtaining a mixed color of the other colors according to the preset illuminance ratio; calculating a third illuminance ratio between the first color, the second color and the mixed color according to the correlation between chromaticity coordinates and tristimulus values, thus obtaining the first ratio between the colors to be mixed; and mixing the colors to be mixed according to the first illuminance ratio to obtain the target chromaticity coordinates;

wherein when the number of said colors to be mixed is three, 1: Cr2: Cr3 is the first illuminance ratio between the colors to be mixed, wherein $$Cr2 = \frac{x1 - x - Ar2 * Cr3}{Ar1},\ Cr3 = \frac{\left(\frac{x1 - x}{Ar1} - \frac{y1 - y}{Br1}\right)}{\left(\frac{Ar2}{Ar1} - \frac{Br2}{Br1}\right)},$$

$$Ar1 = \frac{x * y1}{y2} - \frac{x2 * y1}{y2},\ Ar2 = \frac{x * y1}{y3} - \frac{x3 * y1}{y3},$$

$$Br1 = \frac{y * y1}{y2} - y1,\ \text{and}\ Br2 = \frac{y * y1}{y3} - y1,$$

and x and y are the target chromaticity coordinates, (x1, y1), (x2, y2) and (x3, y3) are the chromaticity coordinates of the three colors to be mixed respectively.

2. An apparatus for realizing fast color mixing of any colors, comprising a processor, a memory, and a computer program stored in said memory and configured to be executed by the processor, wherein the method for realizing fast color mixing of any colors according to claim 1 is implemented when the processor executes said computer program.

3. A method for realizing fast color mixing of any colors, wherein the method comprises steps of receiving target chromaticity coordinates, colors to be mixed and setting information of chromaticity coordinates of the colors to be mixed;

when a number of the colors to be mixed is three, calculating a first illuminance ratio between the colors to be mixed according to a correlation between chromaticity coordinates and tristimulus values;

when the number of the colors to be mixed exceeds three, setting a second illuminance ratio between other colors except for a first and a second color of the colors to be mixed as a preset illuminance ratio, obtaining a mixed color of the other colors according to the preset illuminance ratio; calculating a third illuminance ratio between the first color, the second color and the mixed color according to the correlation between chromaticity coordinates and tristimulus values, thus obtaining the first ratio between the colors to be mixed; and mixing the colors to be mixed according to the first illuminance ratio to obtain the target chromaticity coordinates;

wherein when the number of said colors to be mixed is four, the first illuminance ratio is calculated in another manner characterized by steps of-:

determining an illuminance of a fourth color;

calculating a fourth illuminance ratio between the fourth color and a mixed color of other three colors for achieving the target chromaticity coordinates according to the correlation between chromaticity coordinates and tristimulus values; and calculating a fifth illuminance ratio between the other three colors according to the correlation between the tristimulus values and the chromaticity coordinates;

wherein when the number of said colors to be mixed is four, the first illuminance ratio between the other three colors and the fourth color is calculated as 1: Cr2: Cr3: C*(1+Cr2+Cr3), wherein 1: Cr2: Cr3 is the fifth illuminance ratio between the other three colors, the fourth illuminance ratio between the fourth color and the mixed color of the other three colors is 1:C.

4. An apparatus for realizing fast color mixing of any colors, comprising a processor, a memory, and a computer program stored in said memory and configured to be executed by the processor, wherein the method for realizing fast color mixing of any colors according to claim 3 is implemented when the processor executes said computer program.

5. A method for realizing fast color mixing of any colors, wherein the method comprises steps of receiving target chromaticity coordinates, colors to be mixed and setting information of chromaticity coordinates of the colors to be mixed;

when a number of the colors to be mixed is three, calculating a first illuminance ratio between the colors to be mixed according to a correlation between chromaticity coordinates and tristimulus values;

when the number of the colors to be mixed exceeds three, setting a second illuminance ratio between other colors except for a first and a second color of the colors to be mixed as a preset illuminance ratio, obtaining a mixed color of the other colors according to the preset illuminance ratio; calculating a third illuminance ratio between the first color, the second color and the mixed color according to the correlation between chromaticity coordinates and tristimulus values, thus obtaining the first ratio between the colors to be mixed; and mixing the colors to be mixed according to the first illuminance ratio to obtain the target chromaticity coordinates;

wherein when the number of said colors to be mixed is four, the first illuminance ratio between the four colors to be mixed is calculated as $$1:Cr2:\frac{Cr3}{1+C2}:C2*Cr3(1+C2),$$

wherein the second illuminance ratio between a third color and a fourth color is 1: C2, and the third illuminance ratio between the first color, the second color and the mixed color of the third color and fourth color is 1:Cr2:Cr3.

6. An apparatus for realizing fast color mixing of any colors, comprising a processor, a memory, and a computer program stored in said memory and configured to be executed by the processor, wherein the method for realizing fast color mixing of any colors according to claim 5 is implemented when the processor executes said computer program.

7. A method for realizing fast color mixing of any colors, wherein the method comprises steps of receiving target chromaticity coordinates, colors to be mixed and setting information of chromaticity coordinates of the colors to be mixed;

when a number of the colors to be mixed is three, calculating a first illuminance ratio between the colors to be mixed according to a correlation between chromaticity coordinates and tristimulus values;

when the number of the colors to be mixed exceeds three, setting a second illuminance ratio between other colors except for a first and a second color of the colors to be mixed as a preset illuminance ratio, obtaining a mixed color of the other colors according to the preset illuminance ratio; calculating a third illuminance ratio between the first color, the second color and the mixed color according to the correlation between chromaticity coordinates and tristimulus values, thus obtaining the first ratio between the colors to be mixed; and mixing the colors to be mixed according to the first illuminance ratio to obtain the target chromaticity coordinates;

wherein when the number of said colors to be mixed is five, the first illuminance ratio between the five colors to be mixed is calculated as $$1:Cr2:\frac{1}{Cr3}:\frac{C3}{Cr3}:\frac{C4}{Cr3},$$

wherein the second illuminance ratio between a third color, a fourth color, and a fifth color is 1:C3:C4, and the third illuminance ratio between the first color, the second color and the mixed color of the third color, fourth color, and the fifth color is 1:Cr2:Cr3.

8. An apparatus for realizing fast color mixing of any colors, comprising a processor, a memory, and a computer program stored in said memory and configured to be executed by the processor, wherein the method for realizing fast color mixing of any colors according to claim 7 is implemented when the processor executes said computer program.

* * * * *